US007237703B1

(12) United States Patent
Nathan et al.

(10) Patent No.: US 7,237,703 B1
(45) Date of Patent: Jul. 3, 2007

(54) DOUBLE ENTRY WATER BOTTLE CARRIER FOR A RUNNER

(75) Inventors: Michael Nathan, Stockbridge, MA (US); Robert A. Hartz, Watertown, NY (US)

(73) Assignee: Penguin Brands, Inc., Sharon Hill, PA (US)

( * ) Notice: Subject to any disclaimer, the term of this patent is extended or adjusted under 35 U.S.C. 154(b) by 556 days.

(21) Appl. No.: 10/869,171

(22) Filed: Jun. 16, 2004

(51) Int. Cl.
*A45F 5/00* (2006.01)

(52) U.S. Cl. ..... 224/148.5; 224/148.4; 224/148.7

(58) Field of Classification Search ..... 224/148.1, 224/148.4–148.6, 196, 245, 246, 251, 680, 224/681, 683; D3/229; 383/41; 222/175; 206/583
See application file for complete search history.

(56) References Cited

U.S. PATENT DOCUMENTS 95,240 A * 9/1869 Levy ..... 2/66
5,197,658 A * 3/1993 Sprunger ..... 229/93
5,772,090 A * 6/1998 Rodriguez ..... 224/251
6,182,872 B1 * 2/2001 Six ..... 224/148.5
6,971,562 B2 * 12/2005 Willows et al. ..... 224/148.4

* cited by examiner

*Primary Examiner*—Nathan J. Newhouse
*Assistant Examiner*—Jack Morgan
(74) *Attorney, Agent, or Firm*—Malcolm J. Chisholm; Fox Rothschild LLP

(57) ABSTRACT

A double entry water bottle carrier (10) for runners includes a base (12) having a belt (14) for securing the base (12) to the runner. A sleeve (20) secured to the base (12) is dimensioned to receive a water bottle (22) and defines a first entry (24) and an opposed second entry (26) at opposed ends of the sleeve (20). A flexible securing strap (32) is secured between opposed interior surfaces of the sleeve (20), and is dimensioned so that a central portion (42) of the strap (32) contacts and secures the bottom surface (44) of the water bottle (32) whether a spout (40) of the water bottle extends out of the first entry (24) or second entry (26) of the sleeve (20).

8 Claims, 4 Drawing Sheets

DOUBLE ENTRY WATER BOTTLE CARRIER FOR A RUNNER

TECHNICAL FIELD

The present invention relates to apparatus for supporting water bottles on a person engaged in exercise, and in particular relates to an improved water bottle carrier that provides two opposed entries to a bottle securing sleeve of the carrier for ease of usage by left-handed and right-handed persons.

BACKGROUND ART

It is well known that long distance runners frequently utilize water bottle carriers for avoiding dehydration during long runs, especially during hot weather conditions. Such water bottle carriers are generally secured to the runner by a belt for fastening around the runner's waist. The carriers often also have zippered pockets for securing car keys, a wallet, or similar valuable personal property. In order to avoid irritating bouncing, to minimize contact with a runners hands adjacent the runner's abdomen while running, and to facilitate use of a securing buckle on the belt, known water bottle carriers for runners are typically employed with the water bottle positioned within a sleeve adjacent the runner's lower back and with a securing buckle of the belt adjacent the runner's abdomen.

Additionally, while some water bottle carriers support the bottle at ninety degrees or upright, in order to minimize irritating contact between the bottle and the lower back of the runner, it is known to align the sleeve of the carrier so that the bottle is at about a forty-five degree angle to the runner's back bone. This minimizes a vertical extension of the bottle adjacent the concave curve of the runner's lower back as opposed to an upright or vertical disposition. Such off-set or angled-sleeve water bottle carriers are most often aligned so that a top or spout of the water bottle is angled toward the runner's right shoulder to facilitate extraction and replacement of the water bottle by the majority of runners who are right-handed.

Known water bottle carriers also normally include a cushioned base upon which the sleeve is secured. The base usually also has a wide mesh cover for comfort and breathability. The base is typically secured between the bottle within the sleeve and the runner's back to cushion the bottle and avoid irritating rubbing of the bottle against the runner's back. The cushioning base must extend along the curved lower back of the runner a distance that is adequate to protect the runner's back along a complete vertical extension of the bottle within the sleeve. Therefore, the longer the vertical extension of the bottle up the runner's back, the longer the base must extend to protect the runner.

Consequently, there is a need for an efficient water bottle carrier for runners that may be readily used by both right-handed and left-handed runners; that minimizes a vertical extension of the carrier along the concave curve of a runner's lower back; and that does not significantly increase weight, bulk or cost of manufacture of such a water bottle carrier.

DISCLOSURE OF INVENTION

The invention is a double entry water bottle carrier for a runner that provides for efficient usage of the carrier by right and left-handed runners, and that also provides for a horizontal alignment of the bottle adjacent a concave curve of a runner's lower back to thereby minimize a vertical extension of the bottle along the runner's lower back. The carrier includes a base having a belt for securing the base to the runner. A sleeve is secured to the base and dimensioned to receive and secure a water bottle. The sleeve defines a first entry and an opposed second entry at opposed ends of the sleeve. A flexible securing strap is secured between opposed interior surfaces of the sleeve. The flexible securing strap is dimensioned so that, whenever a spout of the water bottle is secured to extend out of the first entry of the sleeve, a central portion of the securing strap contacts a bottom surface of the water bottle adjacent the second entry of the sleeve to secure the bottle within the sleeve. The securing strap is also dimensioned so that whenever the spout of the water bottle is secured to extend out of the second entry, the central portion of the securing strap contacts the bottom surface of the water bottle adjacent the first entry of the sleeve to secure the bottle within the sleeve. The sleeve also includes a mid-point that is cooperatively dimensioned with the water bottle to secure the water bottle by contacting and applying a securing bias to the water bottle whenever the bottom surface of the water bottle is secured adjacent either the first, or second entry of the sleeve. In an alternative embodiment, a first spout latch is secured to the base adjacent the first entry and a second spout latch is secured to the base adjacent the second entry of the sleeve. The first spout latch is positioned to engage and secure the spout of the water bottle whenever the bottom surface of the water bottle is secured adjacent the second entry of the sleeve. The second spout latch is similarly positioned to engage and secure the spout whenever the bottom surface of the water bottle is secured adjacent the first entry of the sleeve.

The opposed first and second entries facilitate entry of a water bottle into the sleeve from either side of the sleeve so that the carrier may be easily used by right and left-handed runners. By having the securing strap dimensioned to effectively secure the bottom surface of the water bottle whether the bottom surface is adjacent the first or second entry, the carrier provides for ease of use with an absolute minimum of components necessary to secure the water bottle. In a preferred embodiment, the sleeve is secured to the base so that it defines a longitudinal axis that is about parallel to a horizontal plane defined by the belt when being used. That provides for the sleeve being essentially perpendicular to the runner's lower back, so that it minimizes a vertical extension of the sleeve along a concave surface of the runner's lower back, thereby enhancing comfort during use of the carrier.

In a further preferred embodiment, the first and second entries defined by the sleeve may be funnel shaped so that the entries define diameters that are greater than a diameter of a midpoint of the sleeve. The funnel shaped first and second entries facilitate sliding of the water bottle into the sleeve to assist runners who are reaching behind their backs to remove and replace the water bottle within the sleeve. In an additional preferred embodiment, the first and second spout latches include expanded fasteners that secure elastic cords to the base so that the elastic cords define a spout loop dimensioned to readily extend over the spout of the water bottle to facilitate extending the elastic cords to slide over and secure the spout of the water bottle. Additionally, the first and second spout latches may also include wedge-shaped finger tabs secured to the elastic cords to make it easy for a runner to grab the finger tab of the elastic cord to extend the cord over the water bottle spout.

Accordingly, it is a general purpose of the present invention to provide a double entry water bottle carrier for runners that overcomes deficiencies of the prior art.

It is a more specific purpose to provide a double entry water bottle carrier for runners that may be readily used by both right-handed and left-handed runners, and that minimizes a vertical extension of the carrier along the concave curve of a runner's lower back, without significantly increasing the weight, bulk or cost of manufacture of the carrier.

These and other purposes and advantages of the present double entry water bottle carrier for runners will become more readily apparent when the following description is read in conjunction with the accompanying drawings.

DESCRIPTION OF THE PREFERRED EMBODIMENTS

Figure 1:
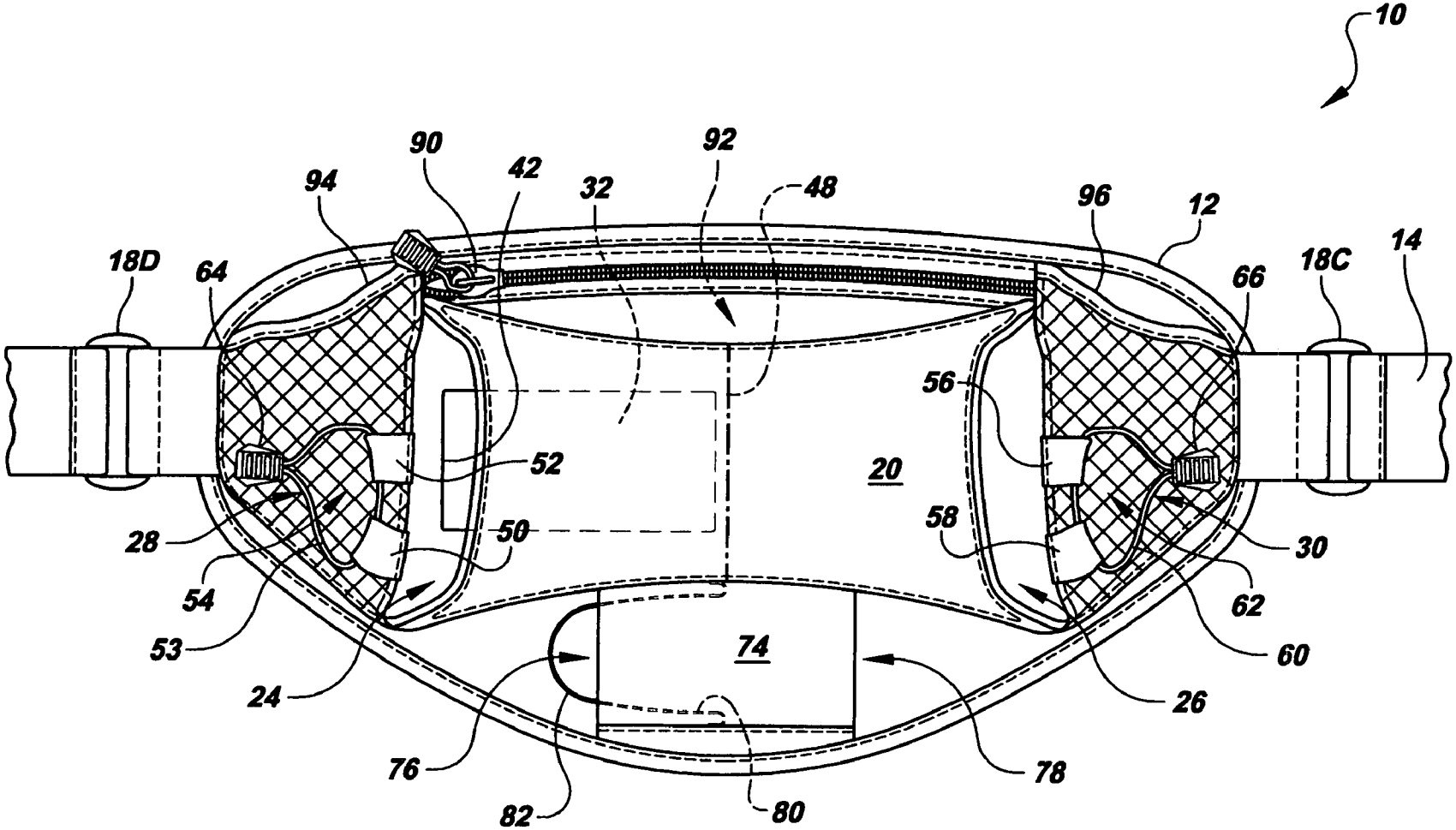
FIG. 1 is a front plan view of a double entry water bottle carrier for a runner constructed in accordance with the present invention.
Figure 2:
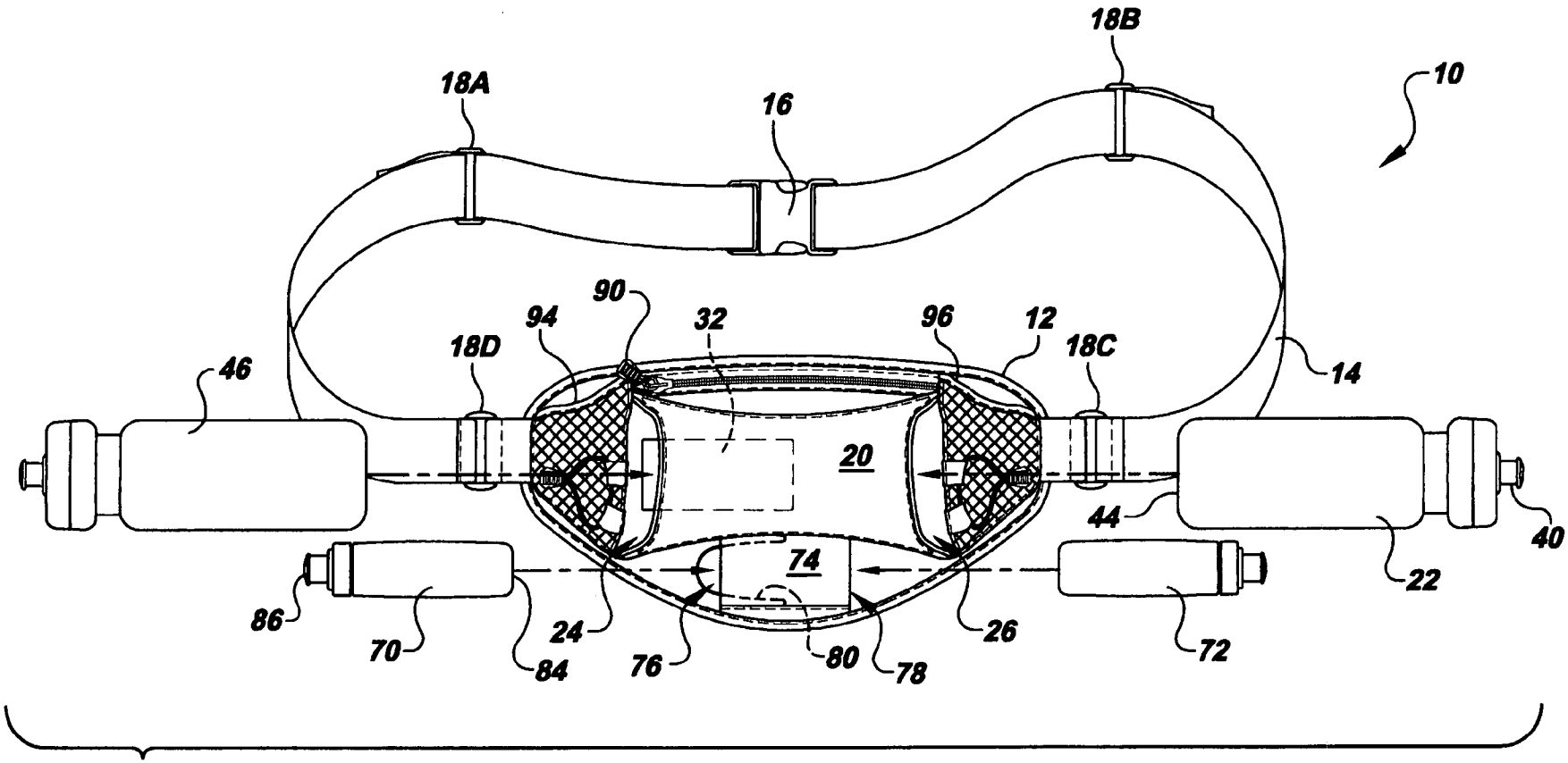
FIG. 2 is a front plan view of the FIG. 1 double entry water bottle carrier showing a belt secured to a base of the carrier and showing water bottles and nutrient bottles aligned for insertion into sleeves of the carrier.
Figure 3:
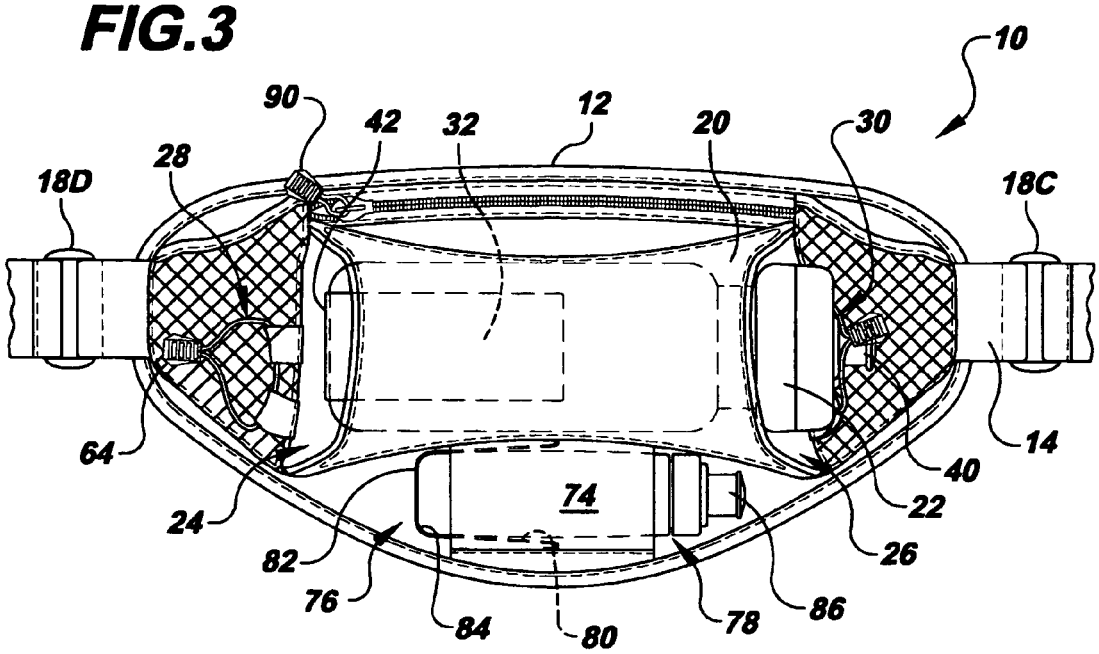
FIG. 3 is a front plan view of the FIG. 1 double entry water bottle carrier showing a water bottle and a nutrient bottle positioned within sleeves of the carrier having bottom surfaces of the bottles adjacent first entries of the sleeves.

Referring to the drawings in detail, a double entry water bottle carrier for a runner of the present invention is shown in FIG. 1, and is generally designated by the reference numeral 10. The carrier 10 includes a base 12 having a belt 14 attached to the base 12 for securing the carrier 10 to a runner (not shown). As seen in FIG. 2, the belt 14 includes a standard buckle 16, and may also include adjustment means 18A, 18B, 18C, 18D, for adjusting the length of the belt 14. A sleeve 20 is secured to the base 12, and as best shown in FIG. 3, the sleeve 20 is dimensioned to receive and secure a water bottle 22. The sleeve defines a first entry 24 and an opposed second entry 26 through which the water bottle 22 may pass to be received in the sleeve 20. A first spout latch 28 is secured to the carrier 10 adjacent the first entry 26, such as by being secured to the base 12. A second spout latch 30 is secured to the carrier adjacent the second entry 28, such as by being secured to the base 12. The first and/or second spout latches 28 could also be secured adjacent the first and second entries 26, 28 of the sleeve 20, such as by being secured to the sleeve 20 itself. A flexible securing strap 32 (shown partially in hatched lines within the sleeve 20 and in solid lines extending out of the sleeve 20 in FIGS. 1–4) is secured between opposed interior surfaces 34, 36 of the sleeve 20, as shown best in FIG. 5, wherein a top interior surface of the sleeve 20 is designated by reference numeral 34, and an opposed bottom surface of the sleeve 20 is designated by reference numeral 36.

The flexible securing strap 32 is dimensioned (meaning it has a suitable length and width) so that, whenever a spout 40 (as shown in FIG. 2) of the water bottle 22 is secured to extend out of the first entry 24 of the sleeve 20, wherein the spout 40 may or may not be secured by the first spout latch 28, a central portion 42 of the securing strap 32 contacts a bottom surface 44 of the water bottle 22 adjacent the second entry 26 of the sleeve 20 (as shown best in FIG. 4) to secure the bottle 22 within the sleeve 20. For purposes herein, the portion of the securing strap 32 characterized as a "central portion 42 of the securing strap 32" is to mean a middle one-fifth or less of the securing strap 32 extending between the top interior surface 34 and the bottom interior surface 36 of the sleeve 20. The flexible securing strap 32 is also dimensioned so that whenever the spout 40 of the water bottle 22 is secured to extend out of the second entry 26 of the sleeve 20, wherein the spout 40 may or may not be secured by the second spout latch 30, the central portion 42 of the securing strap 32 contacts the bottom surface 44 of the water bottle 22 adjacent the first entry 24 of the sleeve 20 to secure the water bottle 22 within the sleeve 20, as shown in FIG. 3. The base 12 of the carrier 10 is dimensioned to extend a distance greater than a length and width of the water bottle 22 and is secured between the water bottle 20 and the body of the runner to thereby protect the runner (not shown) from irritating contact with the bottle 22 while running. The base 12 is typically made of cushioned material covered by a moisture wicking, wide mesh cover 43 (shown in FIGS. 5 and 6) for breathability and avoiding moisture accumulation, as is known in the art.

Figure 4:
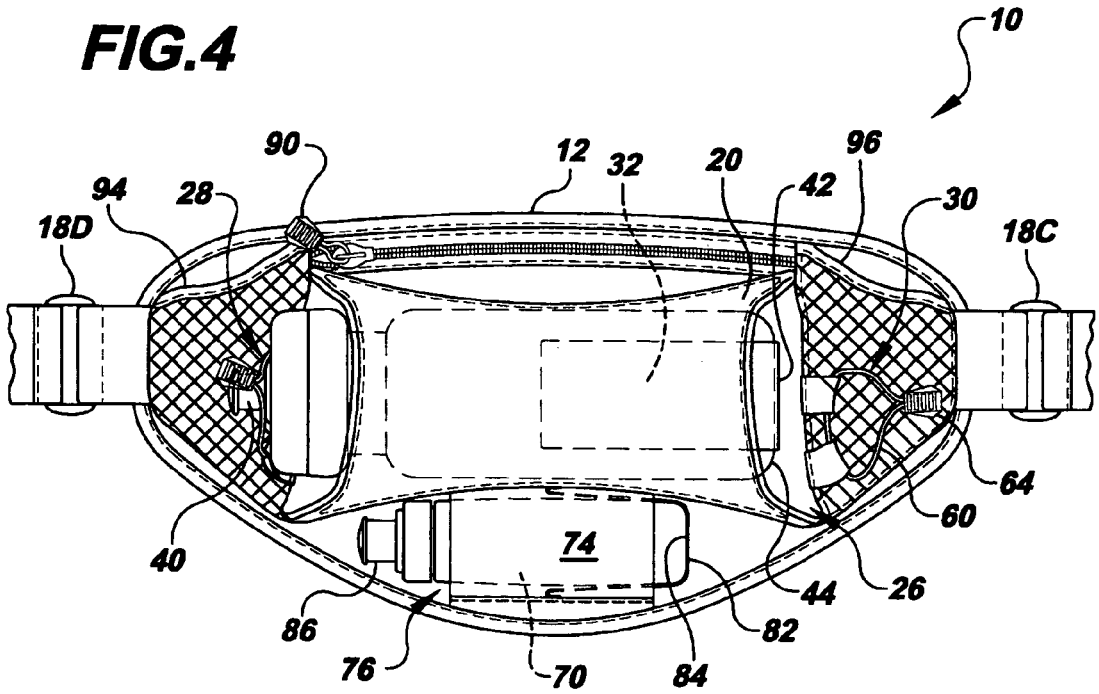
FIG. 4 is a front plan view of the FIG. 1 double entry water bottle carrier showing a water bottle and a nutrient bottle positioned within sleeves of the carrier having bottom surfaces of the bottles adjacent second entries of the sleeves.
Figure 5:
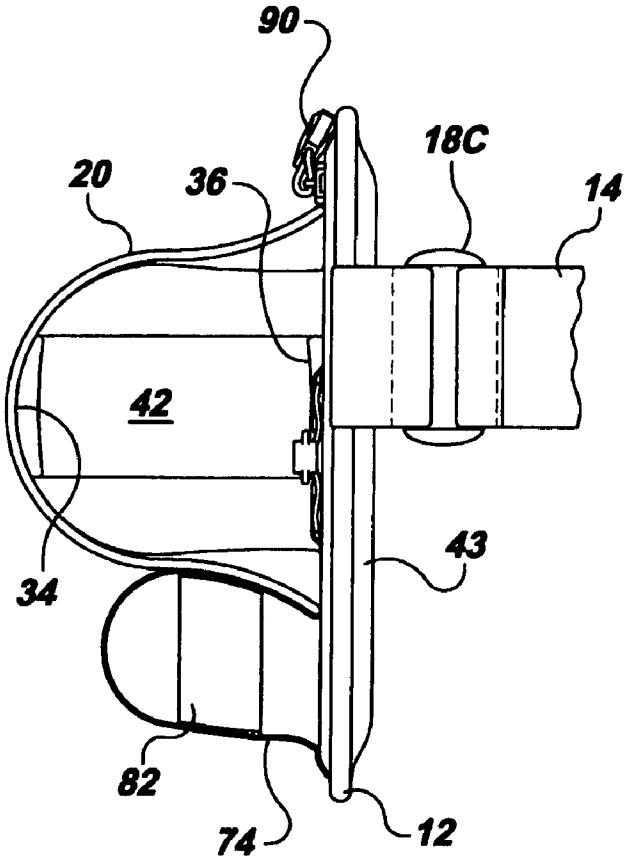
FIG. 5 is a right-side plan view of the FIG. 1 double entry water bottle carrier showing no bottles inserted within sleeves of the carrier and showing securing straps within the sleeves.

As best shown in FIG. 2, the double entry carrier 12 provides for ease of entry into the sleeve 20 by the first water bottle 22 through the second entry 26, or for an equally efficient entry into the sleeve 20 by a second water bottle 46. For efficiency of demonstration in the drawings, two water bottles 22 and 46 are shown, however it is to be understood that under ordinary usage, the same first water bottle 22 would be inserted into the sleeve 20 from either the first or second entry 24, 26 to be secured in either position by opposed surfaces of the central portion 42 of the flexible securing strap 32, as shown in FIGS. 3 and 4.

As best shown in FIG. 2, the sleeve 20 may be secured to the base 12 so that a longitudinal axis of the sleeve 20 is about parallel to a horizontal plane defined by the belt 14 when secured around a waist of a runner (not shown). The phrase "longitudinal axis of the sleeve 20" is defined herein to identify a shortest distance between the first entry 24 and the second entry 26 of the sleeve". The word "about" herein is to mean plus or minus ten percent. By having the sleeve 20 and water bottle 22 received and secured therein in such a horizontal disposition, the sleeve 20 is essentially perpendicular to a backbone (not shown) of a runner (not shown), to thereby minimize a vertical extension of the sleeve 20, bottle 22 and base 12 secured in the sleeve along a concave surface of the runner's back to provide for further comfort to the runner using the carrier 10.

In a further preferred embodiment, the first entry 24 and the second entry 26 may be funnel shaped, so that a shortest distance between opposed surfaces of the first entry 24, and a shortest distance between opposed surfaces of the second entry 26 are each greater than a shortest distance between opposed surfaces of a midpoint 48 of the sleeve 20, as best shown in FIG. 1, wherein the midpoint 48 of the sleeve 20 is designated by the hatched line 48. The funnel shaped first and second entries 24, 26 facilitate entry of the water bottle 22 into the sleeve 20 whenever runners are reaching behind their backs (not shown) to insert and remove the water bottle 22 from the sleeve 20. In an exemplary embodiment of the carrier 10 wherein the first and second entries 24, 26 are funnel shaped, a shortest distance between at least two opposed surfaces of the first entry 24 and a shortest distance between at least two opposed surfaces of the second entry 26 are each at least about ten percent greater than a shortest distance between at least two opposed surfaces of the midpoint 48 of the sleeve. The midpoint 48 of the sleeve may be cooperatively dimensioned with the water bottle 22 to secure the water bottle 22 within the sleeve by contacting and applying a securing bias to the water bottle 22 whenever the bottom surface 44 of the water bottle 22 is secured adjacent either the first entry 24 or second entry 26 of the sleeve 20.

Figure 6:
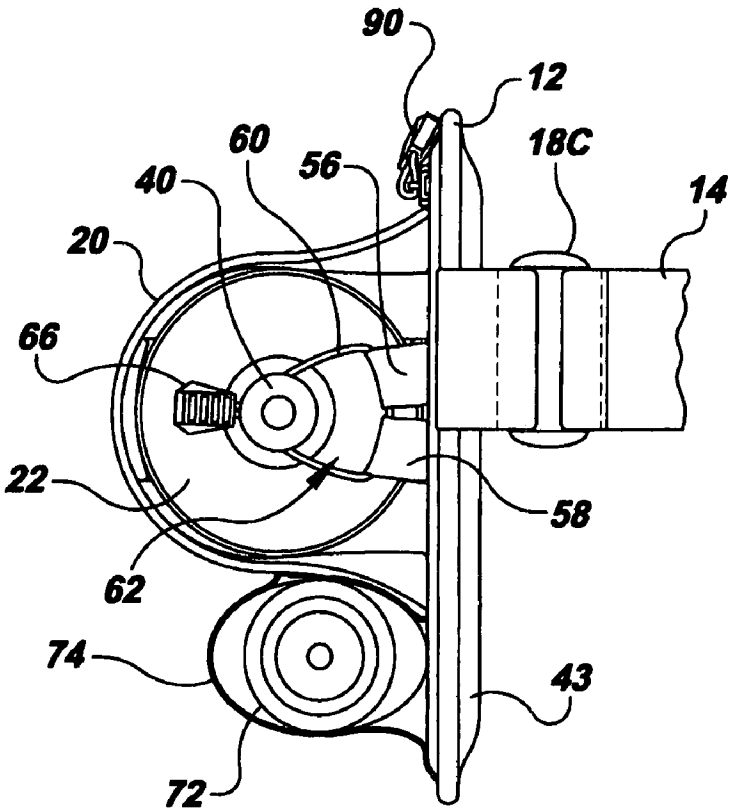
FIG. 6 is a right-side plan view of the FIG. 1 double entry water bottle carrier showing a water bottle and a nutrient bottle inserted within sleeves of the carrier.

In an additional embodiment, the first spout latch 28 may include an expanded fastener means, such as a first fastener 50 and a separate second fastener 52 secured to the base 12 so that an elastic cord 53 passing through the fasteners 50, 52 is expanded to define a first spout loop 54. Similarly, and as best shown in FIGS. 1 and 6, the second spout latch 30 may also include a second expanded fastener means, such as a third fastener 56 and a separate fourth fastener 58 secured to the base 12 so that a second elastic cord 60 passing through the fasteners 56, 58 is expanded to define a second spout loop 62. The first and second spout loops 54, 62 facilitate extension of the elastic cords 53, 60 over the spout 40 of the bottle, again making it easy for a user to secure the bottle 22 within the sleeve 20 when the base 12 is secured adjacent the runner's back (not shown). The first and second expanded fastener means may also include any known apparatus for supporting the elastic cords 53, 60 to define the first and second spout loops 54, 62 to have a diameter that is at least as long as a diameter of the spout 40 of the water bottle to facilitate securing the elastic cords 53, 60 over the spout 40. Additionally, the first spout latch 28 may include a first wedge-shaped finger tab 64 (shown best in FIGS. 1 and 3), and the second spout latch 30 may also include a second wedge-shaped finger tab 66 (shown best in FIGS. 1 and 6) to further facilitate movement of the first and second spout loops 54 and 62 over the spout 40 of the bottle 20 when a runner is securing the bottle within or removing the bottle from the sleeve 20.

It is also known that on long distance runs, runners frequently bring nutrient supplements along in the form of a paste, gel or other easy-to-use form within a nutrient tube 70 or within a second tube 72 shown in FIG. 2. The carrier 10 may include an elastic tube sleeve 74 defining a first entry 76, and an opposed second entry 78 secured to the base 12 of the carrier 10 in about parallel alignment with the water bottle sleeve 20. The elastic tube sleeve 74 may also include a flexible tube securing strap 80 secured to opposed interior surfaces of the elastic tube sleeve 74 and dimensioned so that a central portion 82 of the tube securing strap 80 contacts a bottom surface 84 of the tube adjacent the second entry 78 of the tube sleeve 74 whenever a cap 86 the tube 70 is secured to extend out of the first entry 76 of the tube sleeve 74, as shown in FIG. 4. As shown in FIG. 3, the nutrient-tube securing strap 80 is also dimensioned so that the central portion 82 of the strap 80 also contacts the bottom surface 84 of the nutrient-tube 70 adjacent the first entry 76 whenever the cap 86 of the nutrient tube 70 is secured within the tube sleeve 74 to extent out of the second entry 78 of the tube sleeve 74. While nutrient spout latches (not shown) similar to the above described spout latches could be used to secure the nutrient tube 70 within the tube sleeve 70, it is known that the various nutrient supplements used by runners amount to a modest weight compared to the weight of the filled water bottle 22. Therefore, an elastic tube sleeve 74 made of known elastic materials and dimensioned to be expanded to apply a securing bias to the nutrient tube upon insertion of the nutrient tube 72 into the sleeve 74 is typically adequate to secure the nutrient tube 72 within the tube sleeve 74.

The carrier 10 may also include a zippered entry 90 to a pocket 92 within the base for securing personal property such as car keys (not shown) or wallets (not shown), etc. that a runner needs prior to and after a run. Further, the carrier 10 may include a first pocket 94 of stretch netting secured to the base adjacent the first entry 24 of the water bottle sleeve 20, and a second pocket 96 of stretch netting secured to the base 12 10 adjacent the second entry 26 of the sleeve 20 for storage of personal items a runner (not shown) may need during a run, such as a small spray can of pepper spray (not shown) for unrestrained dogs, a sweat absorbing hand-towel (not shown), etc.

As can be seen, the double entry water bottle carrier 10 for a runner provides an extremely efficient apparatus for securing a water bottle 22 with an absolute minimum of discomfort to the runner. The carrier 10 provides for equal facility for extraction of the bottle 22 out of the sleeve 20 of the carrier 10 and for re-inserting and securing the bottle 22 within the sleeve 20 by both right-handed and left-handed runners when disposed adjacent a runner's lower back (not shown). By the essentially horizontal alignment of the longitudinal axis of the sleeve 20 and water bottle 22 secured within the sleeve 20, the water bottle 22 and the base 12 secured between the water bottle 22 and the lower back of the runner only needs to extend a short vertical distance along the concave curve of the back of the runner, thereby providing further comfort to the runner compared to known water bottle carriers (not shown).

While the present invention has been disclosed with respect to the described and illustrated embodiments of a double entry water bottle carrier 10 for a runner, it is to be understood that the invention is not to be limited to those embodiments. For example, while a conventional, recreational water bottle 20 has been illustrated, it is to be understood that any known dimensions of a liquid container and a corresponding sleeve 20 dimensioned to receive and secure by contact such a liquid container is within the scope of the present invention. Accordingly, reference should be made primarily to the following claims rather than the foregoing description to determine the scope of the invention.

What is claimed is:

1. A double entry water bottle carrier (10) for a runner, the carrier (10) comprising:

a. a base (12) including a belt (14) for securing the base (12) to the runner;

b. a sleeve (20) secured to the base (12) and dimensioned to receive and secure a water bottle (22), the sleeve defining a first entry (24) and an opposed second entry (26) at opposed ends of the sleeve (20);

c. a flexible securing strap (32) secured between opposed interior surfaces of the sleeve (20); and, d. wherein the flexible securing strap (32) is dimensioned so that, whenever a spout (40) of the water bottle (22) is secured to extend out of the first entry (24) of the sleeve (20), a central portion (42) of the securing strap (32) contacts a bottom surface (44) of the water bottle (22) adjacent the second entry (26) of the sleeve (20), and the securing strap (36) is dimensioned so that whenever the spout (40) of the water bottle (22) is secured to extend out of the second entry (26) of the sleeve (20), the central portion (42) of the securing strap (32) contacts the bottom surface (44) of the water bottle (22) adjacent the first entry (24) of the sleeve (20).

2. The double entry water bottle carrier (10) of claim 1, wherein the sleeve (20) is secured to the base (12) so that a longitudinal axis defined by the sleeve is about parallel to a horizontal plane defined by the belt (14) when the belt (14) is being used by the runner to secure the carrier (12) to the runner.

3. The double entry water bottle carrier (10) of claim 1, further comprising a first spout latch (28) secured to the base adjacent the first entry (24) of the sleeve (20) for engaging and securing the spout (40) of the water bottle (22) whenever the bottom surface (44) of the water bottle (22) is secured by the flexible securing strap (32) adjacent the second entry (26) of the sleeve (20), and a second spout latch (30) secured to the base (12) adjacent the second entry (26) of the sleeve (20) for engaging and securing the spout (40) of the water bottle (22) whenever the bottom surface of the water bottle (22) is secured by the flexible securing strap (32) adjacent the first entry (24) of the sleeve (20).

4. The double entry water bottle carrier (10) of claim 1, wherein the first entry (24) of the sleeve (20) is funnel shaped and the second entry (26) of the sleeve (20) is funnel shaped, so that a shortest distance between at least two opposed surfaces of the first entry (24) and a shortest distance between at least two opposed surfaces of the second entry (26) are each at least about ten percent greater than a shortest distance between at least two opposed surfaces of a midpoint (48) of the sleeve (20).

5. The double entry water bottle carrier (10) of claim 3, wherein the first spout latch (28) includes a first expanded fastener means for supporting a first elastic cord (53) to define a first spout loop (54) to have a diameter that is at least as long as a diameter of the spout (40), and wherein the second spout latch (30) includes a second expanded fastener means for supporting a second elastic cord (60) to define a second spout loop (62) to have a diameter that is at least as long as a diameter of the spout (40).

6. The double entry water bottle carrier (10) of claim 5, wherein the first elastic cord (53) of the first spout latch (28) includes a wedge shaped finger tab (64) and the second elastic cord (60) of the second spout latch (30) includes a second wedge shaped finger tab (66).

7. The double entry water bottle carrier (10) of claim 1, wherein a mid-point (48) of the sleeve (20) is cooperatively dimensioned with the water bottle (22) to secure the water bottle by contacting the water bottle (22) and by applying a securing bias to the water bottle (22) whenever the bottom surface (42) of the water bottle (22) is secured adjacent the first entry (24) of the sleeve (20) and whenever the bottom surface (42) of the water bottle (22) is secured adjacent the second entry (26) of the sleeve (20).

8. The double entry water bottle carrier (10) of claim 1, further comprising an elastic tube sleeve (74) secured to the base (12) defining a first entry (76) and an opposed second entry (78), the elastic tube sleeve (74) including a flexible tube securing strap (80) secured to opposed interior surfaces of the elastic tube sleeve (74) and dimensioned so that a central portion (82) of the tube securing strap (80) contacts a bottom surface (84) of a nutrient tube (70) adjacent the second entry (78) of the tube sleeve (74) whenever a cap (86) the tube (70) is secured to extend out of the first entry (76) of the tube sleeve (74), and so that the central portion (82) of the strap (80) also contacts the bottom surface (84) of the tube (70) adjacent the first entry (76) whenever the cap (86) of the tube (70) is secured within the tube sleeve (74) to extent out of the second entry (78) of the tube sleeve (74).

* * * * *